US011319902B2

(12) United States Patent
Andersson et al.

(10) Patent No.: US 11,319,902 B2
(45) Date of Patent: May 3, 2022

(54) FUEL CONTROL SYSTEM

(71) Applicant: Walbro LLC, Tucson, AZ (US)

(72) Inventors: Martin N. Andersson, Caro, MI (US); Dale P. Kus, Cass City, MI (US)

(73) Assignee: Walbro LLC, Cass City, MI (US)

( * ) Notice: Subject to any disclaimer, the term of this patent is extended or adjusted under 35 U.S.C. 154(b) by 35 days.

(21) Appl. No.: 16/960,402

(22) PCT Filed: Jan. 18, 2019

(86) PCT No.: PCT/US2019/014162

§ 371 (c)(1),
(2) Date: Jul. 7, 2020

(87) PCT Pub. No.: WO2019/143915

PCT Pub. Date: Jul. 25, 2019

(65) Prior Publication Data

US 2020/0340427 A1 Oct. 29, 2020

Related U.S. Application Data

(60) Provisional application No. 62/619,149, filed on Jan. 19, 2018.

(51) Int. Cl.
*F02M 17/04* (2006.01)
*F02M 7/18* (2006.01)
(Continued)

(52) U.S. Cl.
CPC ..... *F02M 17/04* (2013.01); *F02M 7/18* (2013.01); *F02B 63/02* (2013.01); *F02B 2075/027* (2013.01); *F02M 19/02* (2013.01)

(58) Field of Classification Search
CPC ..... F02M 17/04; F02M 7/18
See application file for complete search history.

(56) References Cited

U.S. PATENT DOCUMENTS 4,949,692 A 8/1990 Devine
6,135,429 A * 10/2000 Woody ..... F02M 1/08 261/35

(Continued)

FOREIGN PATENT DOCUMENTS

CN 101978152 A 2/2011

OTHER PUBLICATIONS

Written Opinion & International Search Report for PCT/US2019/014162 dated May 15, 2019, 12 pages.

*Primary Examiner* — Robert A Hopkins
(74) *Attorney, Agent, or Firm* — Reising Ethington P.C.; Matthew J. Schmidt

(57) ABSTRACT

In at least some implementations, a charge forming device includes a body having a main bore, a fuel metering assembly including a diaphragm that defines at least part of a fuel chamber from which fuel is provided to the main bore and a reference chamber separate from the fuel chamber, a passage communicated with a subatmospheric pressure source and with the reference chamber, and an electrically actuated valve having an open position and a closed position, and wherein the valve at least substantially prevents communication of the pressure source with the reference chamber when the valve is in the closed position and permits communication of the pressure source with the reference chamber when the valve is in the open position to vary the rate of fuel flow from the fuel chamber.

16 Claims, 5 Drawing Sheets

(51) Int. Cl.

| | |
|---|---|
| *F02B 63/02* | (2006.01) |
| *F02B 75/02* | (2006.01) |
| *F02M 19/02* | (2006.01) |

(56) References Cited

U.S. PATENT DOCUMENTS

| | | | | |
|---|---|---|---|---|
| 7,028,993 | B2 | 4/2006 | Burns | |
| 7,185,623 | B2 | 3/2007 | Shaw | |
| 8,950,381 | B2 | 2/2015 | Larsson et al. | |
| 9,062,629 | B2 | 6/2015 | Burns et al. | |
| 9,062,630 | B2 * | 6/2015 | Kus | F02M 17/04 |
| 2007/0052116 | A1 | 3/2007 | Ishii | |
| 2013/0119567 | A1 | 5/2013 | Burns et al. | |

* cited by examiner

FUEL CONTROL SYSTEM

REFERENCE TO RELATED APPLICATIONS

This application claims the benefit of U.S. Provisional Application Ser. No. 62/619,149 filed on Jan. 19, 2018 the entire contents of which are incorporated herein by reference in its entirety.

TECHNICAL FIELD

The present disclosure relates generally to a charge forming device that provides a fuel and air mixture to an engine to support combustion within the engine.

BACKGROUND

Carburetors are used to provide fuel and air mixtures for a wide range of two-cycle and four-cycle engines, including hand held engines, such as engines for chain saws and weed trimmers, as well as a wide range of lawn and garden and marine engine applications, for example. Diaphragm-type carburetors are particularly useful for hand held engine applications wherein the engine may be operated in substantially any orientation, including upside down.

SUMMARY

In at least some implementations, a charge forming device includes a body having a main bore, a fuel metering assembly including a diaphragm that defines at least part of a fuel chamber from which fuel is provided to the main bore and a reference chamber separate from the fuel chamber, a passage communicated with a subatmospheric pressure source and with the reference chamber, and an electrically actuated valve having an open position and a closed position, and wherein the valve at least substantially prevents communication of the pressure source with the reference chamber when the valve is in the closed position and permits communication of the pressure source with the reference chamber when the valve is in the open position to vary the rate of fuel flow from the fuel chamber.

In at least some implementations, the pressure source is the main bore. And the passage may extend at least partially through the body and through a portion of the diaphragm.

In at least some implementations, a metering body is coupled to the body and defines part of the reference chamber, and the metering body includes a vent communicating atmospheric air with the reference chamber. The minimum diameter of the passage may be greater than the diameter of the vent. The minimum cross-sectional area of the passage may be greater than the cross-sectional area of the vent. At least part of the passage may be formed in the metering body, and the valve may be carried by the metering body, the valve may include a valve head and the metering body may include a valve seat engageable by the valve head when the valve is in the closed position. The minimum cross-sectional area of the passage may be between 3 and 10 times greater than the cross-sectional area of the vent. The diameter of the passage upstream and downstream of the valve seat may be greater than the diameter of the vent.

In at least some implementations, a throttle valve having a valve head is received at least partially within the main bore and the passage is communicated at one end with the main bore at a location downstream of the throttle valve. The passage may be communicated at one end with an area downstream of the throttle valve, which may also be downstream of the main bore.

In at least some implementations, a charge forming device includes a body having a main bore, a throttle valve rotatably carried by the body and having at least a portion received in the main bore, a diaphragm with a first side that defines at least part of a fuel chamber from which fuel is provided to the main bore and a second side that defines at least part of a reference chamber that is separate from the fuel chamber, a passage communicated with a subatmospheric pressure source and with the reference chamber, and an electrically actuated valve having a valve head that is moveable between an open position and a closed position relative to a valve seat. The valve seat is located between the pressure source and the reference chamber and the valve at least substantially prevents communication of the pressure source with the reference chamber when the valve head is in the closed position, and the valve permits communication of the pressure source with the reference chamber when the valve is in the open position to vary the rate of fuel flow from the fuel chamber.

In at least some implementations, the passage is communicated at one end with the main bore at a location downstream of the throttle valve. The pressure source may be the main bore and the passage may extend at least partially through the body and through a portion of the diaphragm. The device may also include a metering body coupled to the body and defining part of the reference chamber, and the metering body may include a vent communicating atmospheric air with the reference chamber. The minimum cross-sectional area of the passage may be greater than the cross-sectional area of the vent. The diameter of the passage upstream and downstream of the valve seat may be greater than the diameter of the vent.

In at least some implementations, an engine system includes an engine including a spark plug, a charge forming device and an ignition circuit. The charge forming device includes a body having a main bore communicated with the engine, a fuel metering assembly including a diaphragm that defines at least part of a fuel chamber from which fuel is provided to the main bore and a reference chamber separate from the fuel chamber, a passage communicated with a subatmospheric pressure source and with the reference chamber, and an electrically actuated valve having an open position and a closed position. The valve at least substantially prevents communication of the pressure source with the reference chamber when the valve is in the closed position and permits communication of the pressure source with the reference chamber when the valve is in the open position to vary the rate of fuel flow from the fuel chamber. The ignition circuit includes one or more coils in which electrical energy is induced during operation of the engine, the ignition circuit is coupled to the spark plug to provide electrical energy to the spark plug, and the ignition circuit is coupled to the electrically actuated valve to provide electrical power to the electrically actuated valve.

In at least some implementations, the ignition circuit includes or is communicated with a controller that controls the timing of when electrical energy is provided to the spark plug, and the controller also controls the actuation of the electrically actuated valve between and among the open position and closed position.

BRIEF DESCRIPTION OF THE DRAWINGS

The following detailed description of certain embodiments and best mode will be set forth with reference to the accompanying drawings, in which.

DETAILED DESCRIPTION

Figure 1:
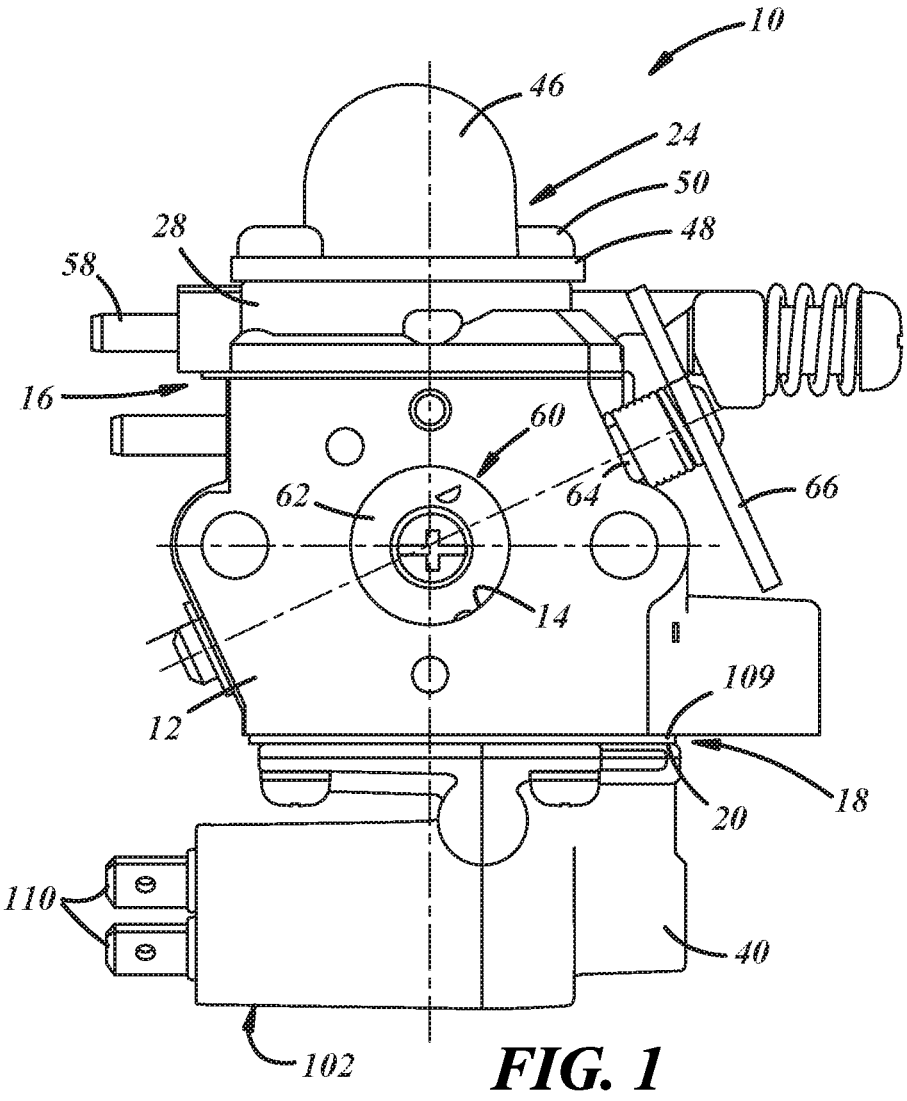
FIG. 1 is a side view of a carburetor including a control valve.
Figure 4:
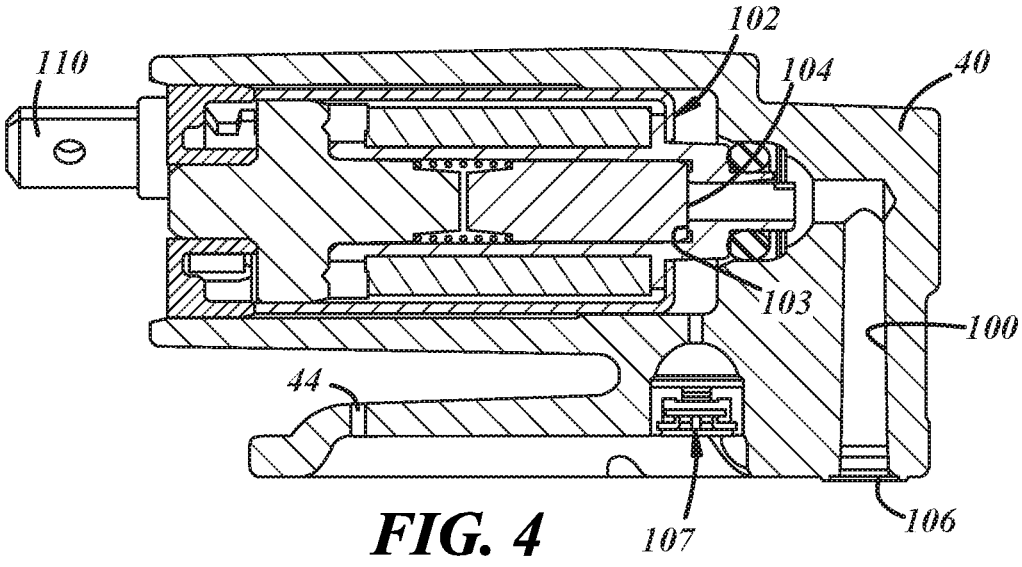
FIG. 4 is a sectional view of a metering body and control valve of the carburetor.
Figure 2:
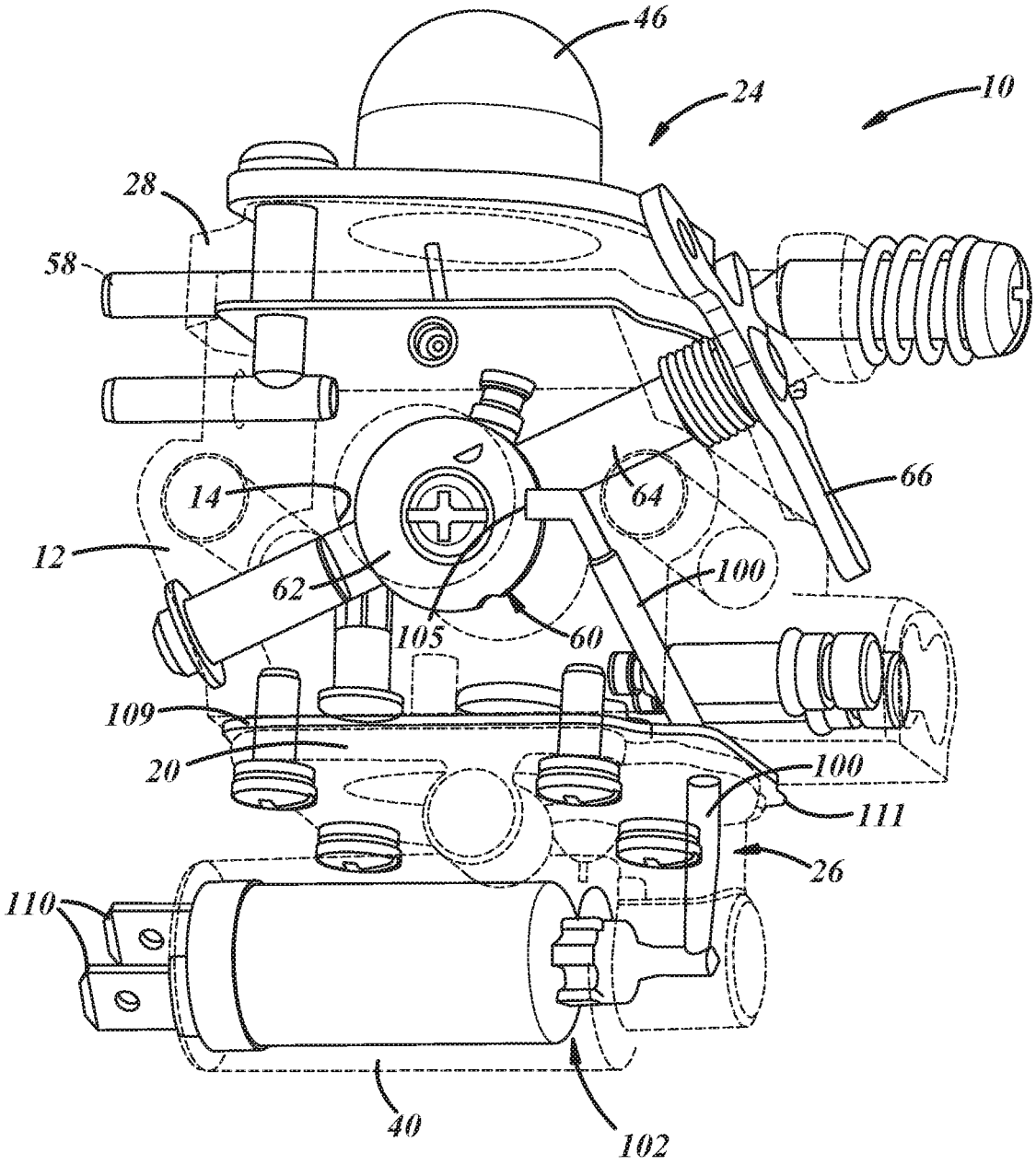
FIG. 2 is a perspective view of the carburetor with one or more bodies of the carburetor shown translucent to illustrate internal components and features.
Figure 3:
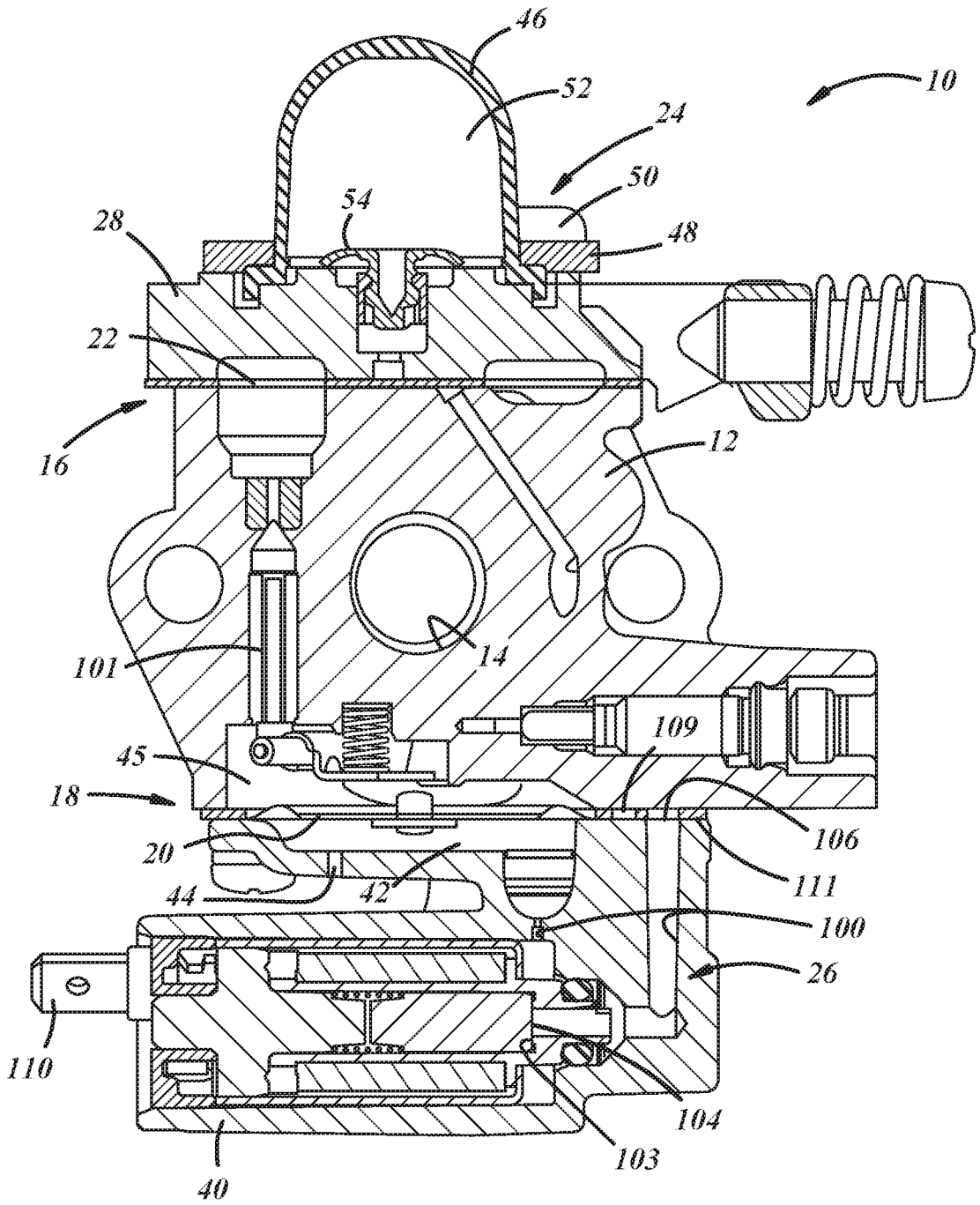
FIG. 3 is a sectional view of the carburetor.

Referring in more detail to the drawings, FIGS. 1-3 illustrate a charge forming device, shown as a carburetor 10, that provides a fuel and air mixture to an engine to support operation of the engine. The carburetor 10 has a main body 12 (typically cast metal) with a main bore 14 through which air flows from an air cleaner to an engine intake. The carburetor 10 also has a fuel circuit through which fuel is provided into the main bore 14 to form the fuel and air mixture. The fuel circuit includes a fuel pump assembly 16 and a fuel metering assembly 18. The fuel metering assembly 18 includes a diaphragm 20 (FIG. 3) that controls the rate at which fuel is delivered into the main bore 14 in accordance with a pressure differential across the metering diaphragm 20. The fuel pump assembly 16 includes a diaphragm 22 that is driven to take in fuel from a fuel source and discharge fuel to the fuel metering assembly 18. To facilitate starting the engine, the fuel circuit may also have a purge and prime circuit 24 through which stale fuel and vapors may be removed from the carburetor 10 as fresh fuel is drawn into the carburetor before starting an engine. At the same time, a metered amount of fuel may be discharged into the main bore to make additional fuel available to the engine prior to starting the engine. And to alter the ratio of air and fuel delivered in a fuel mixture to the engine, the carburetor may include a pressure signal circuit 26 (FIGS. 2-4).

As shown in FIGS. 2-3, the fuel pump assembly 16 may include a fuel pump body 28 that defines part of the fuel pump assembly, including fuel flow paths for the fuel pump assembly, and traps the fuel pump diaphragm 22 against the carburetor main body 12. The fuel metering assembly 18 may include a fuel metering body 40 that traps the fuel metering diaphragm 20 against the carburetor main body 12 and, with the fuel metering diaphragm 20, defines a reference chamber 42 that may be at atmospheric pressure due to a vent 44 formed in the body 40. A fuel metering chamber 45 is defined on the opposite side of the fuel metering diaphragm as the reference chamber and fuel is provided to the main bore 14 from the fuel metering chamber 45 in normal operation of the carburetor 10 and engine. The general constructions and functions of the fuel pump assembly 16 and the fuel metering assembly 18 are known in the art and will not be described further.

The purge and prime circuit 24 is shown in FIGS. 2 and 3. The circuit 24 includes a purge/prime bulb 46 and fuel passages, valves and flow restrictors to control fuel flow in the circuit. A peripheral edge of the bulb 46 is trapped against the fuel pump body 28 by a retainer 48 which may be connected to the fuel pump body 28 by one or more screws 50, which may also couple the fuel pump body 28 to the main body 12. A purge/prime chamber 52 is defined between the interior of the bulb 46 and the fuel pump body 28. The pressure in the chamber 52 increases when the bulb 46 is actuated (e.g. depressed or compressed) to discharge fluids from the chamber 52, and the pressure in the chamber 52 decreases when the bulb 46 returns from its depressed to its normal state to draw fluid into the chamber 52. A two-way valve 54 controls the admission of fluids into the purge/prime chamber 52 and the discharge of fluids therefrom. Fluids may be drawn through the carburetor 10, into the chamber 52 through valve 54, and then discharged from the chamber 52 through valve 54 to the purge passage 58 to purge the carburetor 10 of stale fuel and/or vapors. This pumping action may also draw fresh fuel into the carburetor 10 to prime the carburetor fuel passages with fresh fuel to facilitate starting and operation of the engine.

To control fluid flow through the main bore 14, the carburetor 10 includes a throttle valve 60 disposed in or adjacent to the main bore 14 to control fluid flow therethrough. The throttle valve 60 may be a butterfly-type valve with a thin, flat valve head 62 carried by a throttle valve shaft 64 that extends through and is rotatably carried by the carburetor body 12, and which is fixed to a lever 66 for actuation of the throttle valve 60. In its idle position, the throttle valve 60 substantially restricts fluid flow through the main bore 14, and in its wide-open position, the throttle valve 60 permits a substantially unrestricted air or fluid flow through the main bore 14. As is known in the art, the carburetor 10 may also have a choke valve. The throttle and choke valves may be butterfly type valves as noted above, or may be rotary valves with at least a portion received within the main bore, or of any desired form and arrangement.

Emissions from the engine and engine performance are influenced by things such as fuel type, air leaks, fuel flow changes, and whether the engine is new or broken-in. While the effects of at least some of these may be minimal at wide open throttle (WOT), they can be more severe at lower engine speeds including engine idle or low speed and low load operation. To control an air to fuel ratio of the fuel mixture delivered to the engine, the fuel enleanment system may be used to provide to the engine a leaner than normal fuel and air mixture. The fuel enleanment system includes a pressure pulse passage 100 through which engine pressure pulses are communicated with the fuel metering diaphragm 20, in the reference chamber 42 and on the dry side of the diaphragm 20. When the pressure pulses are communicated with the fuel metering diaphragm 20, the diaphragm 20 is displaced in a direction tending to decrease the size of the reference chamber 42 which increases the volume of the fuel metering chamber 45. This may close a metering valve 101 (FIG. 3) or otherwise decrease the flow rate of fuel discharged from the fuel metering assembly 18 to the main bore 14 and provide an enleaned fuel and air mixture to the engine.

To control when the enleaned fuel and air mixture is supplied to the engine, the fuel enleanment system may include a valve 102 that reduces or prevents application of the pressure pulses through the pressure pulse passage 100. In the implementation shown, the valve 102 is a solenoid valve including a valve head 104 that may be electrically driven from a closed position engaged with a valve seat 103 (which may be defined by or include a seal like an o-ring) preventing pressure pulses from being applied through the pressure pulse passage 100, and an open position spaced from the valve seat 103 and permitting pressure pulses to be applied through the pressure pulse passage 100 to the fuel metering diaphragm 20. The solenoid can be energized to move the valve head 104 to its open position in accordance with a predetermined scheme or algorithm that may take into account many factors including one or more of ambient temperature and engine temperature where the goal of providing an enleaned fuel and air mixture. Of course, the solenoid valve could be energized to provide an enriched fuel and air mixture in other circumstances, as desired. For example, an enriched fuel and air mixture may be desirable to support engine starting and warm-up, acceleration, facilitate deceleration (and prevent a too lean comedown), and/or prevent the engine from operating at too high of a speed.

As shown, the pressure pulse passage is communicated at one end 105 (FIG. 2) with the main bore 14 at a location between the throttle valve and the engine, or with a passage downstream of the carburetor. To receive the engine pressure pulses, the pressure pulse passage 100 may have an inlet 106 in the fuel metering body 40 and/or formed through one or both of a gasket 109 and a trapped periphery 111 (FIG. 3) of the fuel metering diaphragm 20 between the main body 12 and the fuel metering body 40, and may extend past the valve head 104, a check valve 107 (FIG. 4) and open into the reference chamber 42. The engine pressure pulses include positive and negative pressure pulses. The check valve 107 may be arranged to prevent positive pressure pulses from being communicated with the fuel metering diaphragm 20 while permitting negative (e.g. subatmospheric) pressure pulses to act on the diaphragm 20. Of course, other paths may be provided to communicate a pressure signal, like engine pressure pulses, to the metering diaphragm 20 and such paths may include passages within the carburetor bodies 12, 28, 40 and/or tubes or conduits routed outside of the bodies 12, 28, 40. And such paths may communicate with an engine crankcase, intake manifold or other area having a pressure that varies in accordance with engine operation. In at least some implementations, having the passage 100 communicate with the main bore 14 may provide a lower temperature air flow in the passage and to the reference chamber, as compared to, for example, a passage that communicates directly with the engine, for example the crankcase, which may be at a higher temperature in operation including temperatures up to or exceeding 225° F. The main bore may be comparatively cool, and ambient air drawn into the main bore may be at 100° F. or less, which may help cool the carburetor and reduce issues caused by higher heat, such as vaporization of fuel. Further, using the negative portion of the pressure signals provides lower pH levels to the diaphragm 20 and solenoid valve 102 which reduces corrosion of these and other components compared to if the positive portion of the pressure pulses where instead provided through the passage 100. Further, the system may be more responsive to support engine acceleration or other engine operating conditions where a richer fuel supply is desired, because the fuel supply may be enriched by simply turning off and closing the solenoid valve 102 which typically happens more quickly than energizing and opening the valve.

Further, in at least some implementations, the diameter of the passage 100 upstream and downstream of the valve head 104 or valve seat 103 is greater than the diameter of the vent 44 of the reference chamber 42. The minimum cross-sectional area of the passage may be greater than the cross-sectional area of the vent, where the cross-section may be taken perpendicular to the direction of fluid flow through the passage and vent. The vent 44 will attenuate the pressure pulse signals in the chamber 42 by admission of air at atmospheric pressure into the chamber 42. Accordingly, the passage 100 and vent 44 may be sized and arranged to provide a desired pressure pulse strength or magnitude in the reference chamber as well as a desired venting or reduction in vacuum when the valve is closed to permit normal operation of the metering assembly. For example, without limitation, in a 27 cc engine, the minimum diameter of the passage 100 is 1.4 mm and the vent 44 is 0.6 mm. In at least one implementation, with a particular control scheme for the valve, the passage and vent sizes as noted produce a fuel adjustment range of +/−125 g/hr at wide open throttle and +/−75 g/hr at idle, with a stability at a particular setting of +/−5 g/hr. Of course, other sizes and flow rates may be used in a 27 cc engine, as desired, and other sizes and flow rates may be used in engines of other sizes, as desired. The relative passage and vent sizes required for a particular engine application will depend on, for example, the magnitude of the vacuum source, the range of fuel adjustment needed, and the volume of the reference chamber. In at least some implementations, the minimum cross-sectional area of the passage is between ⅓ and 10 times greater than the cross-sectional area of the vent.

Still further, the pressure pulse passages may be used to drive or change a pressure differential across a component other than the fuel metering diaphragm 20. For example, an auxiliary pump (such as shown in U.S. Pat. No. 7,185,623) may be driven by a pressure pulse signal and the solenoid valve 102 may control application of the pressure pulse signal to the auxiliary pump to selectively alter the performance of the auxiliary pump.

The solenoid valve 102 may be carried by the carburetor 10. In the implementation shown, the solenoid valve 102 is incorporated into and carried by the fuel metering body 40 and when closed, the head 104 blocks or substantially restricts a portion of the pressure pulse passage 100 that is formed in the fuel metering body 40. The solenoid valve 102 may be driven by electrical power supplied by an ignition system for the engine, such as a capacitive discharge ignition system. To facilitate wiring the solenoid power leads 110 into the ignition system circuit, the power leads can be wired to the leads of a kill switch or terminal commonly found in an ignition system or otherwise on small engines for such things as chainsaws, weed trimmers, leaf blowers and the like. In this way, the solenoid valve 102 can be used with an engine that does not include a battery, alternator or other similar power source.

In at least some applications, positive pressure pulses even in 2-stroke engines are of minimal magnitude at engine idle, and in other applications such as in 4-stroke engines, positive pressures pulses are not readily available. In such applications, the positive pressure pulses may not provide sufficient change in the air to fuel ratio to enable effective control of the fuel system at engine idle and low speed/low load operation. However, negative pressure pulses of greater magnitude are readily available at idle speed in various engines, including 2-stroke and 4-stroke engines. Accordingly, use of the negative portion of the pressure pulses may facilitate control of the fuel system at engine idle and at other throttle positions and engine operating conditions up to and including wide open throttle operation. Because applying a negative pressure signal to the reference chamber 42 will decrease the flow rate of fuel from the carburetor 10 (i.e. enlean the fuel mixture), the base setting of the carburetor may be set or calibrated to be richer than desired, for at least some engine operating conditions (temperature, speed, altitude, etc). Then, when the negative pressure pulse is applied to the metering diaphragm 20 via the reference chamber 42, the fuel mixture is enleaned compared to the base setting.

While described above as communicating with the main bore downstream of the throttle valve 60, the engine pressure pulse passage may communicate with an engine crankcase or transfer port area, any area within the intake tract (engine or carburetor) that are downstream of the throttle valve 60, any area between the throttle valve and a venturi in the main bore 14 (will provide air/fuel control in all throttle positions except idle wherein the throttle valve is substantially closed). Further, an external negative pressure pump such as a pulse or electrically driven diaphragm pump or a piezo pump may provide negative pressure pulses or a negative pressure signal to the pressure pulse passage.

In at least some implementations, an engine may provide about −3 psi to the passage 100 leading to the solenoid valve 102. The magnitude of the negative pressure that is applied to the metering diaphragm 20 will vary depending on current engine operating conditions, and may vary if the engine is accelerating, decelerating, being started, in steady state operation, at idle, under load, etc. In at least some implementations, the minimum magnitude of the negative pressure applied to the metering diaphragm 20 may be approximately −0.01 mm/Hg greater than the vacuum being applied to the wet side of the metering diaphragm by the engine (e.g. during acceleration). The maximum vacuum may be as high as −5 psi during a deceleration to reduce rich comedown. Of course, other pressure values may be provided or used in different engines. Further, while the solenoid valve 102 is shown and described as being carried by the carburetor body, e.g. by the metering body 40, the solenoid valve 102 can be mounted to the carburetor 10 in other locations, can be mounted remotely from the carburetor (e.g. to a different structure or component) with suitable hoses and/or passages between the solenoid and reference chamber to route the pressure signal/pulses to the metering chamber.

In at least some implementations, the solenoid valve 102 may use a small amount of power (e.g. 150 ma-300 ma, although solenoids outside this range may be used) and the valve 102 may be actuated with the energy generated by or in an ignition circuit as noted below. Further, the relatively low power requirement may also be fulfilled with the energy generated by relatively few magnets on a flywheel, with some implementations requiring only one magnet on the flywheel and with the existing wire coils in the ignition circuit as noted below, that is, additional wire coils need not be added to supply power to the solenoid. A battery is also a viable source of power if available, although many applications will not include a battery. Because an engine has a good source of heat (e.g engine cylinder) and a cooling source (e.g. fins on flywheel)—an electrical generator using the Peltier Theory could also be used. The solenoid valve 102 may be opened and closed using many different sub routines to selectively apply the subatmospheric pressure to the reference chamber 42 and acting on the metering diaphragm 20. These sub-routines may be programmed into a controller, such as a microprocessor that controls operation of the ignition circuit as described below. Less sophisticated methods of controlling the application of the subatmospheric pressure to the metering diaphragm 20 may be used instead or in addition to the solenoid valve 102, such as—a manual actuated valve (e.g. a valve defined by a hole in a rotatable choke valve shaft, that is open in one position of the choke valve and closed in another), hydraulically actuated valves such as using fuel pump pressure to actuate a valve, or a fixed orifice. Accordingly, the subatmospheric pressure may be selectively applied to the metering diaphragm 20 when it is desired to provide a fuel mixture to the engine that is leaner than the base setting for the fuel mixture. For example without limitation, upon initial starting and warming up of a cold engine, it may be desirable to provide a richer fuel mixture so the solenoid valve 102 may remain closed during this phase, or operated at a duty cycle wherein the solenoid valve 102 remains closed more for a given period of time than if the engine is warmed up when started. Thus, by controlling the application of power to the solenoid valve 102, the subatmospheric pressure applied to the metering diaphragm 20 can be controlled.

Figure 5:
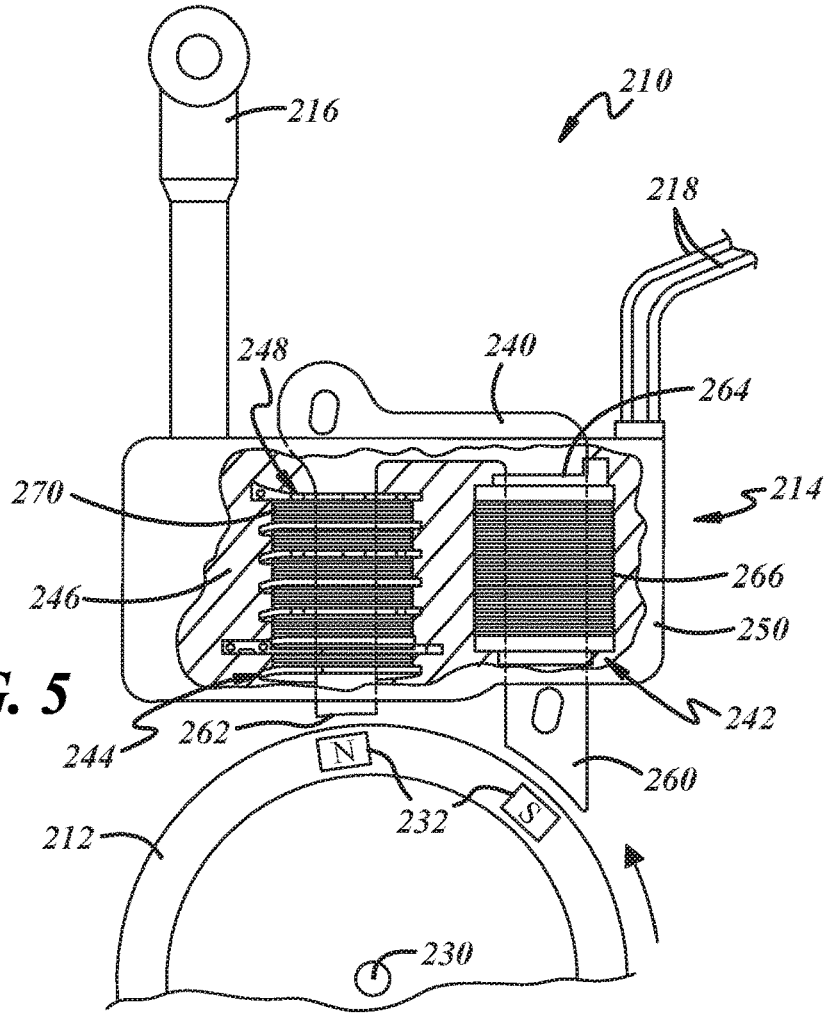
FIG. 5 is a diagrammatic view of an ignition system.

A representative capacitive discharge ignition (CDI) system is shown in FIG. 5. The CDI system 210 interacts with a flywheel 212 and generally includes an ignition module 214, an ignition lead 216 for electrically coupling the ignition module to a spark plug (not shown), and electrical connections 218 for coupling the ignition module to one or more additional electric devices, such as a fuel controlling solenoid. The flywheel 212 shown here includes a pair of magnetic poles or elements 232 located towards a radially outer periphery of the flywheel. Once flywheel 212 is rotating, magnetic elements 232 are moved past and electromagnetically interact with different coil windings in ignition module 214, as is generally known in the art.

Ignition module 214 can generate, store, and utilize the electrical energy that is induced by the rotating magnetic elements 232 in order to perform a variety of functions. According to one embodiment, ignition module 214 includes a lamstack 240, a charge coil 242, a trigger coil 244, an ignition circuit 246, and a step-up transformer 248. Lamstack 240 is preferably a ferromagnetic part that is comprised of a stack of flat, magnetically-permeable, laminate pieces typically made of steel or iron. The lamstack can assist in concentrating or focusing the changing magnetic flux created by the rotating magnetic elements 232 on the flywheel. According to the embodiment shown here, lamstack 240 has a generally U-shaped configuration that includes a pair of legs 260 and 262. Leg 260 is aligned along the central axis of charge coil 242, and leg 262 is aligned along the central axes of trigger coil 244 and transformer 248. When legs 260 and 262 align with magnetic elements 232, which occurs at a specific rotational position of flywheel 212, a closed-loop flux path is created that includes lamstack 240 and magnetic elements 232. Magnetic elements 232 can be implemented as part of the same magnet or as separate magnetic components coupled together to provide a single flux path through flywheel 212, to cite two possibilities. Additional magnetic elements can be added to flywheel 212 at other locations around its periphery to provide additional electromagnetic interaction with ignition module 214.

Charge coil 242 generates electrical energy that can be used by ignition module 214 for a number of different purposes, including charging an ignition capacitor and powering an electronic processing device, to cite two examples. Trigger coil 244 provides ignition module 214 with an engine input signal that is generally representative of the position and/or speed of the engine. According to the particular embodiment shown here, trigger coil 244 is located towards the end of lamstack leg 262 and is adjacent to transformer 248. It could, however, be arranged at a different location on the lamstack. For example, it is possible to arrange both the trigger and charge coils on a single leg of the lamstack, as opposed to arrangement shown here. It is also possible for trigger coil 244 to be omitted and for ignition module 214 to receive an engine input signal from charge coil 242 or some other device.

Transformer 248 uses a pair of closely-coupled windings 268 and 270 to create high voltage ignition pulses that are sent to a spark plug via an ignition lead 216. Like the charge and trigger coils described above, the primary and secondary windings of transformer 248 surround one of the legs of lamstack 240, in this case leg 262. The primary winding 268 has fewer turns of wire than the secondary winding 270, which has more turns of finer gauge wire. The turn ratio between the primary and secondary windings, as well as other characteristics of the transformer, affect the high voltage and are typically selected based on the particular application in which it is used, as is appreciated by those skilled in the art.

Figure 6:
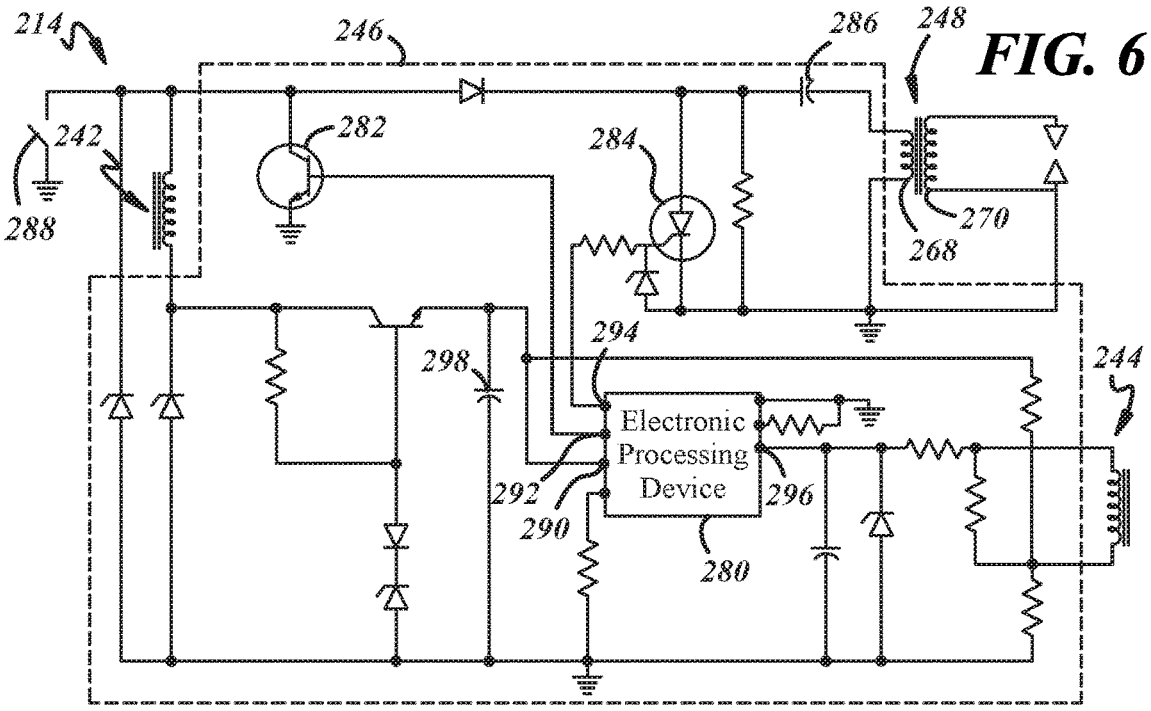
FIG. 6 is a schematic view of an ignition circuit that may be used to power the control valve.

Turning now to FIG. 6, there is shown a schematic circuit diagram illustrating some of the components of an exemplary ignition module 214, including charge coil 242, trigger coil 244, ignition circuit 246, and transformer 248. It should be understood that numerous changes, including the addition, omission and/or substitution of various electrical components, could be made to this diagram as it is merely intended to provide a general overview of one possible implementation. Ignition circuit 246 can utilize a number of different electrical components including, in this embodiment, an electronic processing device 280, a first switching device 282, a second switching device 284, and an ignition capacitor 286. As will be described further below, first switching device 282 can be used as a charge coil clamping switch to implement a flyback charging technique with ignition capacitor 286, whereas second switching device 284 is used to discharge ignition capacitor 286 for spark generation.

Electronic processing device 280 executes various electronic instructions pertaining to a variety of tasks, such as ignition timing control, and can be a microcontroller, a microprocessor, an application specific integrated circuit (ASIC), or any other suitable type of analog or digital processing device known in the art. The electronic processing device is generally powered by charge coil 242 via various electronic components, including capacitor 298, that smooth or otherwise regulate the energy induced in the charge coil. According to the embodiment shown here, electronic processing device 280 includes the following exemplary input/output arrangement: a power input 290 from charge coil 242, a signal output 292 for providing a charge control signal to first switching device 282, a signal output 294 for providing a discharge control signal to second switching device 284, and a signal input 296 for receiving an engine input signal from trigger coil 244 via a number of signal conditioning circuit components. It should be appreciated that numerous circuit arrangements, including ones other than the exemplary arrangement shown here, could be used to process, condition, or otherwise improve the quality of signals used herein. While the engine input signal on input 296 is schematically shown here as provided in serial fashion on a single input, this and other signals could instead be provided on multiple inputs or according to some other arrangement known in the art. A kill switch 288, which acts as a manual override for shutting down the engine, could also be coupled to electronic processing device 280.

First switching device 282 couples charge coil 242 to ground, and is controlled by the charge control signal sent on output 292. When the charge control signal turns 'on' first switching device 282 so that it is conductive, charge coil 242 is shorted to ground. Conversely, when the charge control signal turns first switching device 282 'off', the short is removed and charge coil 242 is free to charge ignition capacitor 286.

Second switching device 284 is arranged to discharge ignition capacitor 286 in order to create a spark at the spark plug. In this embodiment, second switching device 284 is part of an energy discharge path that also includes primary winding 268, ignition capacitor 286, and ground. Second switching device 284 is controlled at its gate by the discharge control signal sent on output 294. During normal charging conditions, second switching device 284 is turned 'off' so that electrical energy induced in charge coil 242 can charge ignition capacitor 286.

At a predetermined point in an engine cycle (as may be determined from the engine input signal), electronic processing device 280 sends a charge control signal to first switching device 282 that causes it to turn 'on'. As first switching device 282 is turned 'on', it provides a low impedance ground path for charge coil 242; effectively shorting the charge coil so that current induced in the coil can flow through the closed switching device 282 to ground. Due to the shorting of charge coil 242, the charge coil does not charge ignition capacitor 286 during this initial stage of the charge cycle.

Electronic processing device 280 continues to monitor the engine input signal or some other appropriate indicator, electronic processing device 280 turns 'off' first switching device 282. At the time that first switching device 282 is turned off, there is a high level of current flowing from charge coil 242, through switching device 282, to ground. The abrupt change or interruption in current flow through charge coil 242 causes a flyback-type event in ignition module 214, that is, a collapsing magnetic field. The collapsing magnetic field in turn creates a high voltage output that is redirected and applied to ignition capacitor 286 according to a flyback charging technique. In at least some implementations, throughout the rest of the charging cycle, both switching devices 282 and 284 are maintained in an 'off' state so that ignition capacitor 286 can fully charge.

Figure 7:
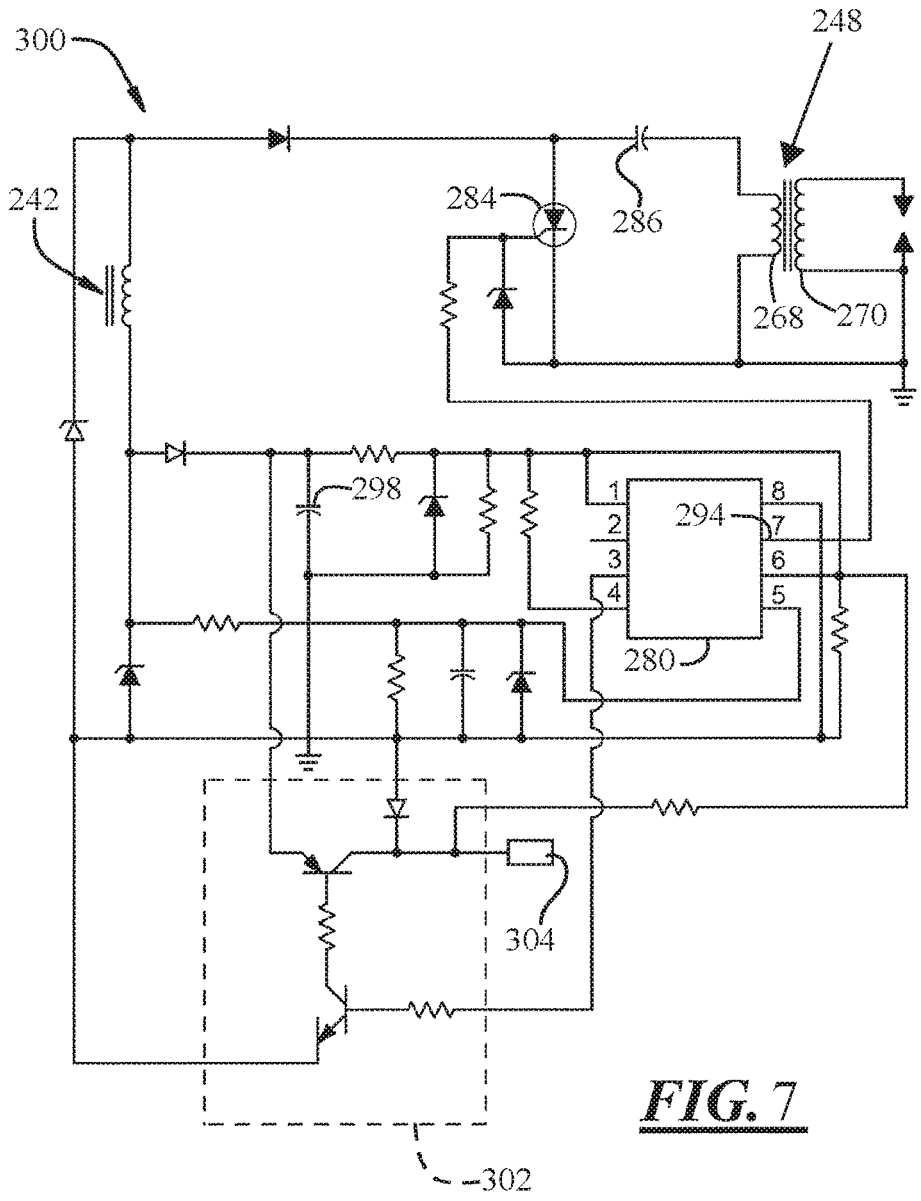
FIG. 7 is a schematic view of an ignition circuit that may be used to power the control valve.

Of course, other ignition circuit and control strategies may be utilized. The above is just representative of the power supply circuit or system that may be used to power the solenoid valve 102, conveniently with the same circuit used to control ignition in the engine, in at least some implementations. Another example of a power supply and ignition circuit 300 is shown in FIG. 7. In this circuit 300 components the same as or similar to components described with reference to the circuit of FIG. 6 are given the same reference numeral to facilitate description and understanding of the circuit of FIG. 7 without having to further describe such components. This ignition circuit 300 may include a solenoid driver subcircuit 302 communicated with pin 3 of the electronic processing device 280 and with the solenoid 102 at a node or connector 304.

It is to be understood that the foregoing description is not a definition of the invention, but is a description of one or more preferred embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, a method having greater, fewer, or different steps than those shown could be used instead. All such embodiments, changes, and modifications are intended to come within the scope of the appended claims.

As used in this specification and claims, the terms "for example," "for instance," "e.g.," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A charge forming device, comprising:

a body having a main bore;

a fuel metering assembly including a diaphragm that defines at least part of a fuel chamber from which fuel is provided to the main bore and a reference chamber separate from the fuel chamber;

a passage communicated with a subatmospheric pressure source and with the reference chamber, wherein the pressure source is the main bore; and an electrically actuated valve having an open position and a closed position, and wherein the valve at least substantially prevents communication of the pressure source with the reference chamber when the valve is in the closed position and permits communication of the pressure source with the reference chamber when the valve is in the open position to vary the rate of fuel flow from the fuel chamber wherein the passage extends at least partially through the body and through a portion of the diaphragm.

2. The device of claim 1 which also includes a metering body coupled to the body and defining part of the reference chamber, wherein the metering body includes a vent communicating atmospheric air with the reference chamber.

3. The device of claim 2 wherein the minimum diameter of the passage is greater than the diameter of the vent.

4. The device of claim 2 wherein the minimum cross-sectional area of the passage is greater than the cross-sectional area of the vent.

5. The device of claim 2 wherein at least part of the passage is formed in the metering body, and wherein the valve is carried by the metering body, the valve includes a valve head and the metering body includes a valve seat engageable by the valve head when the valve is in the closed position.

6. The device of claim 4 wherein the minimum cross-sectional area of the passage is between 3 and 10 times greater than the cross-sectional area of the vent.

7. The device of claim 1 which also includes a throttle valve having a valve head received at least partially within the main bore and wherein the passage is communicated at one end with the main bore at a location downstream of the throttle valve.

8. The device of claim 1 which also includes a throttle valve having a valve head received at least partially within the main bore and wherein the passage is communicated at one end with an area downstream of the throttle valve.

9. The device of claim 5 wherein the diameter of the passage upstream and downstream of the valve seat is greater than the diameter of the vent.

10. A charge forming device, comprising:

a body having a main bore;

a throttle valve rotatably carried by the body and having at least a portion received in the main bore;

a diaphragm with a first side that defines at least part of a fuel chamber from which fuel is provided to the main bore and a second side that defines at least part of a reference chamber that is separate from the fuel chamber;

a passage communicated with a subatmospheric pressure source and with the reference chamber; and an electrically actuated valve having a valve head that is moveable between an open position and a closed position relative to a valve seat, the valve seat is located between the pressure source and the reference chamber and the valve at least substantially prevents communication of the pressure source with the reference chamber when the valve head is in the closed position, and the valve permits communication of the pressure source with the reference chamber when the valve is in the open position to vary the rate of fuel flow from the fuel chamber wherein the pressure source is the main bore and wherein the passage extends at least partially through the body and through a portion of the diaphragm.

11. The device of claim 10 wherein the passage is communicated at one end with the main bore at a location downstream of the throttle valve.

12. The device of claim 10 which also includes a metering body coupled to the body and defining part of the reference chamber, wherein the metering body includes a vent communicating atmospheric air with the reference chamber.

13. The device of claim 12 wherein the minimum cross-sectional area of the passage is greater than the cross-sectional area of the vent.

14. The device of claim 12 wherein the diameter of the passage upstream and downstream of the valve seat is greater than the diameter of the vent.

15. An engine system, comprising:

an engine including a spark plug;

a charge forming device, including:

a body having a main bore communicated with the engine;

a fuel metering assembly including a diaphragm that defines at least part of a fuel chamber from which fuel is provided to the main bore and a reference chamber separate from the fuel chamber;

a passage communicated with a subatmospheric pressure source and with the reference chamber; and an electrically actuated valve that is moveable between an open position and a closed position to at least substantially prevent communication of one or more subatmospheric pressure signals from the pressure source with the reference chamber when the valve is in the closed position and to permit communication of one or more subatmospheric pressure signals from the pressure source with the reference chamber when the valve is in the open position to vary the rate of fuel flow from the fuel chamber wherein the pressure source is the main bore and wherein the passage extends at least partially through a portion of the diaphragm; and an ignition circuit including one or more coils in which electrical energy is induced during operation of the engine, the ignition circuit being coupled to the spark plug to provide electrical energy to the spark plug, and the ignition circuit being coupled to the electrically actuated valve to provide electrical power to the electrically actuated valve.

16. The system of claim 15 wherein the ignition circuit includes or is communicated with a controller that controls the timing of when electrical energy is provided to the spark plug, and wherein the controller also controls the actuation of the electrically actuated valve between and among the open position and closed position.

* * * * *